US011519665B2

(12) United States Patent
Wei et al.

(10) Patent No.: US 11,519,665 B2
(45) Date of Patent: Dec. 6, 2022

(54) REFRIGERATOR DRAWER ASSEMBLY

(71) Applicant: HAIER SMART HOME CO., LTD., Shandong (CN)

(72) Inventors: Dong Wei, Qingdao (CN); Jian Zhang, Qingdao (CN); Jun Nie, Qingdao (CN); Ning Wang, Qingdao (CN); Xiao Ding, Qingdao (CN)

(73) Assignee: HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 17/266,823

(22) PCT Filed: Aug. 2, 2019

(86) PCT No.: PCT/CN2019/099096
§ 371 (c)(1),
(2) Date: Feb. 8, 2021

(87) PCT Pub. No.: WO2020/029887
PCT Pub. Date: Feb. 13, 2020

(65) Prior Publication Data

US 2021/0341218 A1 Nov. 4, 2021

(30) Foreign Application Priority Data

Aug. 8, 2018 (CN) ..... 201821273949.9

(51) Int. Cl.
*F25D 25/02* (2006.01)
*F25D 23/06* (2006.01)
*A47B 88/975* (2017.01)

(52) U.S. Cl.
CPC ..... *F25D 25/025* (2013.01); *A47B 88/975* (2017.01); *F25D 23/069* (2013.01); *A47B 2210/175* (2013.01); *F25D 2325/021* (2013.01)

(58) Field of Classification Search
CPC .... F25D 25/025; F25D 23/069; F25D 25/022; F25D 2325/021; A47B 88/975; A47B 2210/175; A47B 57/585
See application file for complete search history.

(56) References Cited

U.S. PATENT DOCUMENTS

2013/0099651 A1* 4/2013 Hwang ..... F25D 23/069 312/404
2014/0265802 A1* 9/2014 Wilcox ..... F25D 25/025 312/404

(Continued)

FOREIGN PATENT DOCUMENTS

CN 102679681 A 9/2012
CN 106257190 A 12/2016

(Continued)

OTHER PUBLICATIONS

International Search Report for PCT/CN2019/099096 (ISA/CN) dated Oct. 28, 2019 with English translation (4 pages).

(Continued)

*Primary Examiner* — Kimberley S Wright
(74) *Attorney, Agent, or Firm* — Alston & Bird LLP

(57) ABSTRACT

A refrigerator drawer assembly, comprising: a drawer body, the drawer body comprising a front wall and a rear wall arranged opposite to each other along the pulling direction thereof, and defining an accommodating cavity used for placing articles, wherein the front wall is provided with two first sliding grooves extending along the horizontal direction and running along the thickness direction thereof, and the rear wall is provided with two second sliding grooves aligned with the two first sliding grooves; and two sliding partition assemblies, wherein two ends of each sliding partition assembly are inserted into a set of a first sliding groove and a second sliding groove that are aligned, and the two sliding partition assemblies are configured to be able to (Continued)

slide along the first sliding grooves and the second sliding grooves and are capable of sliding to a fitted state. The drawer assembly may achieve two-chamber separation and three-chamber separation of the drawer body, thereby effectively improving the user experience.

7 Claims, 2 Drawing Sheets

(56) References Cited

U.S. PATENT DOCUMENTS

| | | | | |
|---|---|---|---|---|
| 2018/0116399 | A1* | 5/2018 | Lee | A47B 88/90 |
| 2018/0149415 | A1 | 5/2018 | Jo et al. | |
| 2019/0357679 | A1* | 11/2019 | Li | F25D 25/022 |
| 2020/0196754 | A1* | 6/2020 | Wang | F25D 25/025 |
| 2020/0232701 | A1* | 7/2020 | Li | F25D 23/069 |
| 2021/0341216 | A1* | 11/2021 | Wei | F25D 25/024 |
| 2021/0341217 | A1* | 11/2021 | Wei | F25D 25/025 |

FOREIGN PATENT DOCUMENTS

| | | | |
|---|---|---|---|
| CN | 206410424 | U | 8/2017 |
| CN | 208817848 | U | 5/2019 |
| KR | 20130062135 | A | 6/2013 |

OTHER PUBLICATIONS

Extended European Search Report for EP Application No. 19848475.0 dated Aug. 6, 2021 (4 pages).
1st Office Action for EP Application No. 19848475.0 dated Aug. 11, 2021 (5 pages).

* cited by examiner

REFRIGERATOR DRAWER ASSEMBLY

CROSS-REFERENCE TO RELATED APPLICATIONS

The present application is a national phase entry of International Application No. PCT/CN2019/099096, filed Aug. 2, 2019, which claims priority to Chinese Patent Application No. 20181273949.9, filed Aug. 8, 2018, respectively, which are incorporated herein by reference in their entirety.

FIELD OF THE INVENTION

The present invention relates to the technical field of refrigerator storage devices, and particularly relates to a refrigerator drawer assembly.

BACKGROUND OF THE INVENTION

Generally, a drawer for storage is disposed inside a refrigerator chamber. In order to improve the utilization efficiency of the drawer, partition plates are disposed inside the drawer, and the drawer is separated into different spaces by changing positions of the partition plates to meet storage requirements.

In order to realize the separation of a plurality of cavities, in the prior art, two or more partition plates are usually disposed inside the drawer to separate the space inside the drawer into a plurality of cavities.

However, most of the partition plates in the prior art are provided with independent sliding grooves. For example, a left partition plate is provided with an independent left sliding groove, and a right partition plate is provided with an independent right sliding groove, so that the left and right partition plates can only slide within a certain range, the number of separated cavities is fixed, and the user experience is poor.

BRIEF DESCRIPTION OF THE INVENTION

One objective of the present invention is to provide a refrigerator drawer assembly which can effectively improve the user experience.

Another objective of the present invention is to simultaneously realize the separation of two cavities and three cavities of a drawer body through two partition plates.

Particularly, the present invention provides a refrigerator drawer assembly, including:

a drawer body, including a front wall and a rear wall which are arranged oppositely along a pulling direction, wherein the drawer body defines an accommodating cavity for placement of objects, the front wall is provided with two first sliding grooves which extend along a horizontal direction and penetrate through a thickness direction thereof, and the rear wall is provided with two second sliding grooves which are aligned with the two first sliding grooves respectively; and two sliding partition plate assemblies, arranged in the accommodating cavity along the pulling direction of the drawer body, wherein two ends of each sliding partition plate assembly are inserted into a group of the first sliding groove and the second sliding groove which are aligned with each other, and the two sliding partition plate assemblies are configured to be capable of sliding along the first sliding grooves and the second sliding grooves and can slide to a state of being attached to each other.

Optionally, each sliding partition plate assembly includes:

a partition plate, extending along the pulling direction of the drawer body and arranged in the accommodating cavity; and two sliding mechanisms, respectively arranged at two ends of the partition plate along a length direction thereof, wherein one end of the sliding mechanism is connected to the partition plate, and the other end passes through the first sliding groove or the second sliding groove and forms sliding connection with the drawer body.

Optionally, the drawer body includes a first side wall and a second side wall which are perpendicular to the pulling direction thereof, the side, facing the first side wall, of the sliding mechanism of the partition plate close to the first side wall does not protrude from the side of the connected partition plate close to the first side wall; and the side, facing the second side wall, of the sliding mechanism of the partition plate close to the second side wall does not protrude from the side of the connected partition plate close to the second side wall.

Optionally, each sliding mechanism includes:

a sliding base, arranged on the outer side of the front wall or the rear wall; and a connecting piece, wherein one end of the connecting piece is detachably connected to the sliding base, and the other end passes through the first sliding groove or the second sliding groove and is fixedly connected to the partition plate.

Optionally, each sliding mechanism further includes:

a guide rod, extending along the horizontal direction, wherein two ends of the guide rod are fixed to the drawer body; and the sliding base is sleeved over the guide rod.

Optionally, the sliding base is provided with two lifting lugs, the lifting lug is provided with a through hole penetrating through the lifting lug along an axial direction of the guide rod, and the through hole is used for penetration of the guide rod.

Optionally, the top of the sliding base protrudes to form the two lifting lugs, and the bottom of the sliding base is clamped with the connecting piece.

Optionally, each sliding mechanism further includes:

limiting blocks, arranged at two ends of each guide rod and configured to limit the extreme position of the sliding base along the sliding direction thereof.

Optionally, the side of the limiting block facing the sliding base is further provided with a shock absorbing ring.

Optionally, the refrigerator drawer assembly is configured to be arranged in a temperature-variable chamber of a refrigerator.

The front wall of the drawer body of the present invention is provided with two first sliding grooves which extend along a horizontal direction, and the rear wall is provided with two second sliding grooves which are aligned with the two first sliding grooves. In this way, two sliding partition plate assemblies slide in the corresponding sliding groove groups when moving, and are independent of each other without interference. Therefore, the sliding partition plate assemblies can slide to a state of being attached to each other, and the accommodating cavity of the drawer body can be separated into two cavities. When the two sliding partition plate assemblies are separated, the accommodating cavity of the drawer body can be separated into three cavities, thereby realizing the separation of two cavities and three cavities, meeting the diverse needs of users for storage, and effectively improving the user experience.

Further, in the present invention, the partition plate and the sliding mechanism on the side, facing the first side wall, of the sliding partition plate assembly close to the first side wall are arranged to be basically flush, or the sliding mechanism on this side is retracted into the partition plate, so that the partition plate can be attached to the first side wall as much as possible when sliding to the first side wall, and the extreme position of the partition plate cannot be limited due to the protrusion of the sliding mechanism. Similarly, the sliding partition plate assembly close to the second side wall is also arranged in the same form, so that it can be attached to the second side wall as much as possible, so as to expand the moving stroke of the partition plate to a greater extent.

According to the following detailed descriptions of specific embodiments of the present invention in conjunction with the drawings, those skilled in the art will more clearly understand the above and other objectives, advantages and features of the present invention.

BRIEF DESCRIPTION OF THE DRAWINGS

Some specific embodiments of the present invention are described in detail below with reference to the drawings by way of example and not limitation. The same reference numerals in the drawings indicate the same or similar components or parts. Those skilled in the art should understand that these drawings are not necessarily drawn in scale. In the drawings.

DETAILED DESCRIPTION

Figure 1:
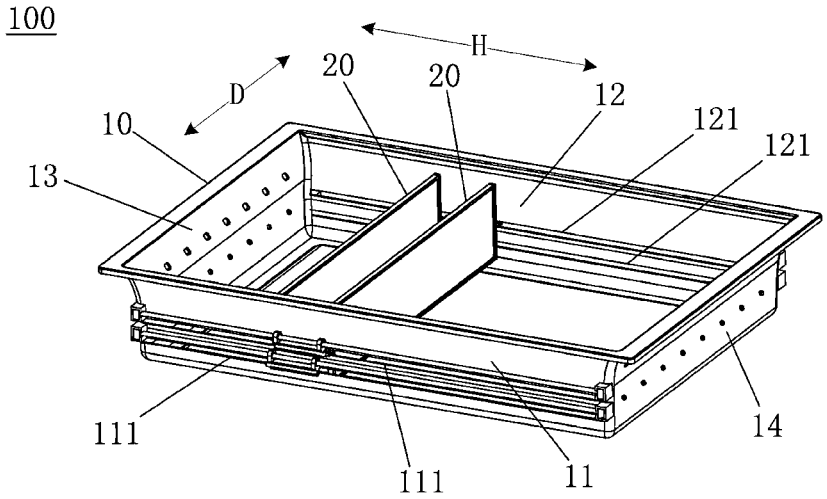
FIG. 1 is a schematic structural diagram of a refrigerator drawer assembly according to an embodiment of the present invention.

FIG. 1 is a schematic structural diagram of a refrigerator drawer assembly according to an embodiment of the present invention. As shown in FIG. 1, the present embodiment provides a refrigerator drawer assembly 100 which may generally include a drawer body 10 and two sliding partition plate assemblies 20. The drawer body 10 includes a front wall 11 and a rear wall 12 which are arranged oppositely along a pulling direction thereof, the drawer body defines an accommodating cavity for placement of objects, the front wall 11 is provided with two first sliding grooves 111 which extend along a horizontal direction and penetrate through a thickness direction thereof, and the horizontal direction H here is the extending direction of the first sliding groove 111 when the drawer body 10 is placed horizontally. Each first sliding groove 111 penetrating through the front wall 11 along the thickness direction of the front wall 11 means that the bottom of the first sliding groove 111 is of a hollow structure, and the front wall 11 located in the bottom area of the first sliding groove 111 is penetrated. The rear wall 12 is provided with two second sliding grooves 121 aligned with the two first sliding grooves 111 respectively. The second sliding grooves 121 can penetrate through the rear wall 12 along the thickness direction of the rear wall 12 accordingly. The thickness direction of the front wall 11 and the rear wall 12 is the pulling direction D of the drawer assembly 100. Two sliding partition plate assemblies 20 are both arranged in the drawer body 10, two ends of each sliding partition plate assembly 20 are inserted into a group of the first sliding groove 111 and the second sliding groove 121 which are aligned with each other, and the two sliding partition plate assemblies 20 are configured to be capable of sliding along the first sliding groove 111 and the second sliding groove 121 and can slide to a state of being attached to each other.

In the present embodiment, the front wall 11 of the drawer body 10 is provided with two first sliding grooves 111 which extend along a horizontal direction, and the rear wall 12 is provided with two second sliding grooves 121 which are aligned with the two first sliding grooves 111. In the present embodiment, the two groups of aligned first sliding grooves 111 and second is sliding grooves 121 are respectively referred to as an upper sliding groove group and a lower sliding groove group, wherein the lower sliding groove group is located below the upper sliding groove group. Two ends of one sliding partition plate assembly 20 are inserted into the upper sliding groove group, and two ends of the other sliding partition plate assembly 20 are inserted into the lower sliding groove group. In this way, the two sliding partition plate assemblies 20 slide in the corresponding sliding groove groups when moving, and are independent of each other without interference. Therefore, the two sliding partition plate assemblies 20 can slide to a state of being attached to each other. That is, the right side of the sliding partition plate assembly 20 on the left side of the drawer body 10 is attached to the left side of the sliding partition plate assembly 20 on the right side of the drawer body 10, and at this time, the accommodating cavity of the drawer body 10 can be separated into two cavities. When the two sliding partition plate assemblies 20 are separated, the accommodating cavity of the drawer body 10 can be separated into three cavities, thereby realizing the separation of two cavities and three cavities, meeting the diverse needs of users for storage, and effectively improving the user experience.

Further, in the present embodiment, the first sliding groove 111 and the second sliding groove 121 can also be used as air vents, so that the air in the refrigerator chamber can circulate inside the drawer body 10.

Figure 2:
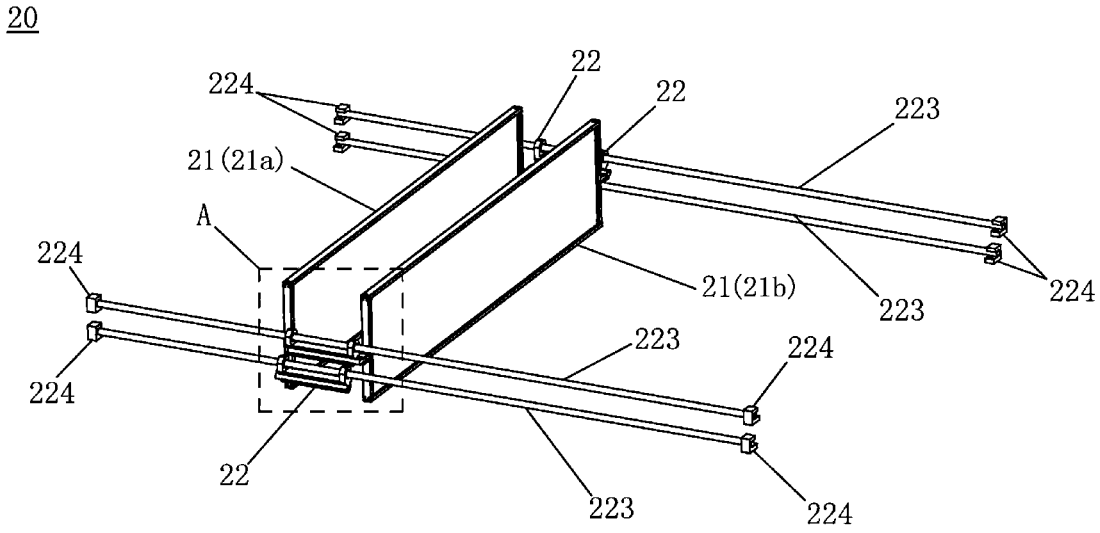
FIG. 2 is a schematic structural diagram of a sliding partition plate assembly of a refrigerator drawer assembly according to an embodiment of the present invention.

FIG. 2 is a schematic structural diagram of a sliding partition plate assembly of a refrigerator drawer assembly according to an embodiment of the present invention. FIG. 2 shows a schematic structural diagram of two sliding partition plate assemblies. As shown in FIG. 2, in an embodiment, each sliding partition plate assembly 20 includes a partition plate 21 and two sliding mechanisms 22. The partition plate 21 extends along the pulling direction D of the drawer body 10 and is arranged in the accommodating cavity. The two sliding mechanisms 22 are respectively arranged at two ends of the partition plate 21 along the length direction thereof, one end of the sliding mechanism 22 is connected to the partition plate 21, and the other end passes through the first sliding groove 111 or the second sliding groove 121 and forms sliding connection with the drawer body 10. The connection between the sliding mechanism 22 and the partition plate 21 may be fixed connection or detachable connection, and the detachable connection can facilitate the removal of the partition plate 21 so as to facilitate cleaning.

In another embodiment, as shown in FIG. 1, the drawer body 10 includes a first side wall 13 and a second side wall 14 which are perpendicular to the pulling direction thereof. The side, facing the first side wall 13, of the sliding mechanism 22 of the partition plate 21 close to the first side wall 13 does not protrude from the side of the connected partition plate 21 close to the first side wall 13. The side, facing the second side wall 14, of the sliding mechanism 22 of the partition plate 21 close to the second side wall 14 does not protrude from the side of the connected partition plate 21 close to the second side wall 14. That is, two partition plates 21 of the two sliding partition plate assemblies 20 may include a first partition plate 21*a* close to the first side wall 13 and a second partition plate 21*b* close to the second side wall 14. The side, facing the first side wall, of the sliding mechanism 22 of the first partition plate 21*a* 13 does not protrude from the side of the first partition plate 21*a* close to the first side wall 13. The side, facing the second side wall 14, of the sliding mechanism 22 of the second partition plate 14 does not protrude from the side of the second partition plate 14 close to the second side wall 14.

In the present embodiment, the partition plate 21 and the sliding mechanism 22 on the side, facing the first side wall 13, of the sliding partition plate assembly 20 close to the first side wall 13 are arranged to be basically flush, or the sliding mechanism 22 on this side is retracted into the partition plate 21, so that the partition plate 21 can be attached to the first side wall 13 as much as possible when sliding to the first side wall 13, and the extreme position of the partition plate 21 can not be limited due to the protrusion of the sliding mechanism 22. Similarly, the sliding partition plate assembly 20 close to the second side wall 14 is also arranged in the same form, so that it can be attached to the second side wall 14 as much as possible. The present embodiment can expand the moving stroke of the partition plate 21 to a greater extent.

Figure 3:
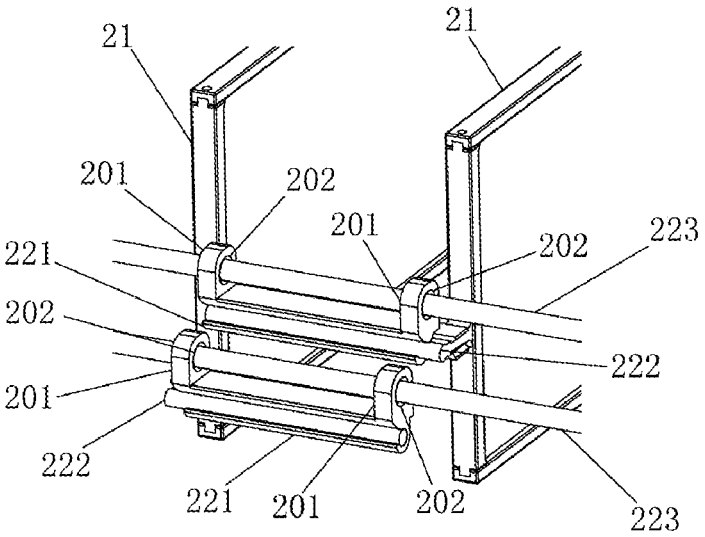
FIG. 3 is an enlarged view of a part A in FIG. 2.

FIG. 3 is an enlarged view of a part A in FIG. 2. As shown in FIG. 2, in an embodiment, each sliding mechanism 22 includes a sliding base 221 and a connecting piece 222. The sliding base 221 is arranged on the outer side of the front wall 11 or the rear wall 12. One end of the connecting piece 222 is detachably connected to the sliding base 221, and the other end passes through the first sliding groove 111 or the second sliding groove 121 and is fixedly connected to the partition plate 21. The sliding mechanism 22 is configured to include the sliding base 221 and the connecting piece 222 which are detachably connected, so as to facilitate the disassembly and assembly of the sliding mechanism 22.

In another embodiment, as shown in FIG. 2, each sliding mechanism 22 further includes a guide rod 223, the guide rod 223 extends along a horizontal direction, two ends of the guide rod are fixed to the drawer body 10, and the sliding base 221 is sleeved over the guide rod 223. By arranging the guide rod 223, the sliding mechanism 22 is restrained by the first sliding groove 111, the second sliding groove 121 and the guide rod 223 when sliding, so that the sliding track is more stable.

Optionally, as shown in FIG. 3, the sliding base 221 is provided with two lifting lugs 201, the lifting lug 201 is provided with a through hole 202 penetrating through the lifting lug 201 along an axial direction of the guide rod 223, and the through hole is used for penetration of the guide rod 223.

In an embodiment, as shown in FIG. 3, the top of the sliding base 221 protrudes to form the two lifting lugs 201, and the bottom of the sliding base 221 is clamped with the connecting piece 222.

In another embodiment, as shown in FIG. 2, each sliding mechanism 22 further includes limiting blocks 224 which are arranged at two ends of each guide rod 223 and are configured to limit the extreme position of the sliding base 221 along the sliding direction thereof. That is, the left and right ends of the guide rod 223 are provided with the limiting blocks 224 for limiting the extreme position of the sliding mechanism 22 at the left and right ends.

Optionally, the side of the limiting block 224 facing the sliding base 221 is further provided with a shock absorbing ring (not shown). The arrangement of the shock absorbing ring can effectively alleviate the impact of the sliding base 221 when sliding to the limiting block 224. The shock absorbing ring may be made of a silicone material.

Optionally, the refrigerator drawer assembly 100 is configured to be arranged in a temperature-variable chamber of a refrigerator. Usually, an independent temperature-variable chamber is arranged between an upper refrigerating chamber and a lower freezing chamber of a high-end French refrigerator, a drawable temperature-variable drawer is arranged in the temperature-variable chamber, and the refrigerator drawer assembly 100 of the present invention can be used as the temperature-variable drawer.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and deemed to cover all such other variations or modifications.

The invention claimed is:

1. A refrigerator drawer assembly, comprising:

a drawer body, comprising a front wall and a rear wall which are arranged oppositely along a pulling direction, wherein the drawer body defines an accommodating cavity for placement of objects, the front wall is provided with two first sliding grooves extending along a horizontal direction, the rear wall is provided with two second sliding grooves aligned with the two first sliding grooves respectively, and each of the first sliding grooves penetrates through the front wall along a thickness direction of the front wall; and two sliding partition plate assemblies, each of said sliding partition plate assemblies comprising a partition plate, wherein two ends of a first sliding partition plate assembly of the sliding partition plate assemblies are inserted into a first group of the first sliding groove and the second sliding groove that are aligned with each other, two ends of a second sliding partition plate assembly of the sliding partition plate assemblies are inserted into a second group of the first sliding groove and the second sliding groove that are aligned with each other, and the two sliding partition plate assemblies are configured to be capable of sliding along respective groups of the first sliding groove and the second sliding groove and can slide to a state in which said partition plates are attached to each other, wherein the partition plate of each sliding partition plate assembly extends along the pulling direction of the drawer body and arranged in the accommodating cavity, wherein each sliding partition plate assembly further comprises: two sliding mechanisms, respectively arranged at two ends of the partition plate along a length direction thereof, one end of each of the sliding mechanisms is connected to the partition plate, and the other end passes through one of the first sliding grooves or one of the second sliding grooves and forms sliding connection with the drawer body, wherein each of the sliding mechanisms comprises:

a sliding base, arranged on the outer side of the front wall or the rear wall; and a connecting piece, wherein one end of the connecting piece is detachably connected to the sliding base, and the other end passes through the first sliding groove or the second sliding groove and is fixedly connected to the partition plate, wherein each of the sliding mechanisms further comprises:

a guide rod, extending along the horizontal direction, wherein two ends of the guide rod are fixed to the drawer body;

and the sliding base is sleeved over the guide rod.

2. The refrigerator drawer assembly according to claim 1, wherein the drawer body comprises a first side wall and a second side wall which are perpendicular to the pulling direction thereof, and the partition plates of the two sliding partition plate assemblies comprise a first partition plate close to the first side wall and a second partition plate close to the second side wall;

the side, facing the first side wall, of the sliding mechanism of the first partition plate does not protrude from the side of the first partition plate close to the first side wall; and the side, facing the second side wall, of the sliding mechanism of the second partition plate does not protrude from the side of the second partition plate close to the second side wall.

3. The refrigerator drawer assembly according to claim 1, wherein each of the sliding bases is provided with two lifting lugs, each of the lifting lugs is provided with a through hole penetrating through the lifting lug along an axial direction of the guide rod, and the guide rod penetrates through the through hole.

4. The refrigerator drawer assembly according to claim 3, wherein the top of each of the sliding bases protrudes to form the two lifting lugs, and the bottom of each of the sliding bases is clamped with the connecting piece.

5. The refrigerator drawer assembly according to claim 1, wherein each of the sliding mechanisms further comprises:

a plurality of limiting blocks, wherein two ends of each of the guide rods are provided with the limiting blocks for limiting the extreme position of the sliding base along a sliding direction thereof.

6. The refrigerator drawer assembly according to claim 5, wherein the side of each of the limiting blocks facing the sliding base is further provided with a shock absorbing ring.

7. The refrigerator drawer assembly according to claim 1, wherein the refrigerator drawer assembly is configured to be arranged in a temperature-variable chamber of a refrigerator.

* * * * *